US009644495B2

(12) United States Patent
Zurmehly et al.

(10) Patent No.: US 9,644,495 B2
(45) Date of Patent: May 9, 2017

(54) THERMAL ISOLATING SERVICE TUBES AND ASSEMBLIES THEREOF FOR GAS TURBINE ENGINES

(71) Applicant: HONEYWELL INTERNATIONAL INC., Morristown, NJ (US)

(72) Inventors: Ed Zurmehly, Phoenix, AZ (US); Cristopher Frost, Scottsdale, AZ (US); Michael O'Brien, Goodyear, AZ (US); Donald G Godfrey, Phoenix, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 713 days.

(21) Appl. No.: 13/971,671

(22) Filed: Aug. 20, 2013

(65) Prior Publication Data

US 2015/0052872 A1 Feb. 26, 2015

(51) Int. Cl.

| | |
|---|---|
| ***F02C 1/00*** | (2006.01) |
| ***F01D 25/12*** | (2006.01) |
| ***F01D 25/18*** | (2006.01) |
| ***F01D 9/06*** | (2006.01) |
| ***F01D 25/14*** | (2006.01) |
| ***F01D 25/26*** | (2006.01) |

(52) U.S. Cl.

CPC ..... *F01D 25/125* (2013.01); *F01D 9/065* (2013.01); *F01D 25/145* (2013.01); *F01D 25/18* (2013.01); *F01D 25/26* (2013.01)

(58) Field of Classification Search

CPC ..... F01D 25/183; F01D 25/186; F01D 25/20; F01D 25/18; F02C 7/14; F02C 7/06; F16N 2210/02

See application file for complete search history.

(56) References Cited

U.S. PATENT DOCUMENTS 3,057,542 A * 10/1962 Keenan ..... F01D 11/04 384/317
4,076,452 A * 2/1978 Hartmann ..... F01D 9/065 415/142
4,531,358 A 7/1985 Smith
(Continued)

FOREIGN PATENT DOCUMENTS

CN 101670437 A 3/2010
CN 102748393 A 10/2012
(Continued)

OTHER PUBLICATIONS

Ameli, M., et al.: "A novel method for manufacturing sintered aluminium heat pipes (SAHP)" Applied Thermal Engineering, vol. 52, Issue 2; Apr. 15, 2013; pp. 498-504. ISSN 1359-4311 [Retrieved Jun. 10, 2013].

*Primary Examiner* — Gerald L Sung
(74) *Attorney, Agent, or Firm* — Lorenz & Kopf, LLP

(57) ABSTRACT

Thermal isolating service tubes and assemblies thereof for gas turbine engines are provided. The thermal isolating service tube comprises an inner tubular member defining a fluid passage and at least one outer tubular member disposed about the inner tubular member. A spacing volume is defined between at least the inner tubular member and an adjacent outer tubular member. The thermal isolating service tube comprises a unitary structure and has at least one portion with a curved configuration, a non-circular cross-sectional shape, or both.

18 Claims, 10 Drawing Sheets

(56) References Cited

U.S. PATENT DOCUMENTS

| | | | | |
|---|---|---|---|---|
| 4,914,904 | A * | 4/1990 | Parnes | F01D 9/065 165/168 |
| 5,746,574 | A * | 5/1998 | Czachor | F01D 5/189 285/368 |
| 6,412,820 | B1 * | 7/2002 | Erps | F16L 19/005 285/123.1 |
| 6,439,616 | B1 * | 8/2002 | Karafillis | F01D 9/065 285/205 |
| 7,093,418 | B2 | 8/2006 | Morris et al. | |
| 8,188,488 | B2 | 5/2012 | Andrews et al. | |
| 8,371,812 | B2 | 2/2013 | Manteiga et al. | |
| 2006/0042223 | A1 * | 3/2006 | Walker | F01D 9/065 60/39.08 |
| 2009/0104027 | A1 * | 4/2009 | Duchatelle | F01D 9/065 415/175 |
| 2010/0135786 | A1 * | 6/2010 | Manteiga | F01D 9/065 415/232 |
| 2010/0236215 | A1 * | 9/2010 | Venkataramani | F01D 9/065 60/39.093 |
| 2012/0060508 | A1 * | 3/2012 | Alecu | F01D 25/20 60/783 |
| 2013/0055721 | A1 | 3/2013 | Fang et al. | |
| 2013/0223985 | A1 * | 8/2013 | Hashimoto | F01D 11/001 415/111 |

FOREIGN PATENT DOCUMENTS

| | | | |
|---|---|---|---|
| EP | 2276270 | A1 | 1/2011 |
| WO | 2013048772 | A1 | 4/2013 |

* cited by examiner

THERMAL ISOLATING SERVICE TUBES AND ASSEMBLIES THEREOF FOR GAS TURBINE ENGINES

STATEMENT REGARDING FEDERALLY SPONSORED RESEARCH OR DEVELOPMENT

This invention was made with Government support under W911W6-08-2-0001 awarded by the Army (AATE) Program. The Government has certain rights in this invention.

TECHNICAL FIELD

The present invention generally relates to gas turbine engines, and more particularly relates to thermal isolating service tubes and assemblies thereof for gas turbine engines.

BACKGROUND

A gas turbine engine includes one or more shafts which are mounted for rotation in several bearings, usually of the rolling-element type. The bearings are enclosed in enclosures called "bearing sumps" which are pressurized and supplied with an oil flow for lubrication and cooling. In most cases one of the boundaries of the bearing sump will be a dynamic seal between a rotating component of the engine and an engine stationary structure. Various tubes, collectively referred to herein as "service tubes", are used to supply oil to the bearing sump (an "oil supply tube"), to drain spent oil from the bearing sump (a "drain" or "scavenge tube"), to pressurize the bearing sump with air (a "pressure tube"), and to vent air from the bearing sump (a "ventilation tube").

The bearings and bearing sumps are mounted within a casing of the engine using a stationary structural frame that provides a structural load path from the bearings. An exemplary conventional stationary structural frame may include a central hub connected to an annular outer rim with a plurality of radial struts. The service tubes are frequently routed internally of the struts, sometimes in a limited frame strut area, that challenges the ability to route the service tubes (oil supply, scavenge, pressure, and ventilation tubes) to bearing sumps. In addition, a conventional stationary structural frame may cross the flowpath of the turbine, thus exposing the service tubes to high temperatures in operation. After the engine stops, the oil that normally cools the bearings stops flowing. The heat stored in the turbine then raises the temperature of the bearings much higher than when the engine was running, tending to cause undesirable oil coking within the service tubes. "Coking" refers to the undesirable accumulation of carbon particles. Increased coking may lead to increased seal wear and adversely impacts bearing life. Increased oil coking can also result in removal of the engine from service and can increase engine overhaul costs.

Accordingly, it is desirable to provide thermal isolating service tubes and assemblies thereof for gas turbine engines that are configured to provide thermal isolation from high external temperatures (e.g., from hot combustion gas) to reduce heat loads and coking therein, resulting in reduced maintenance, reduced heat rejection requirements, increased bearing and engine life, reduced overhaul requirements, and reduced engine removals. It is also desirable to provide thermal isolating service tubes and assemblies thereof for gas turbine engines that enable easier routing of the tubes within the gas turbine engine. Furthermore, other desirable features and characteristics of the present invention according to exemplary embodiments will become apparent from the subsequent detailed description and the appended claims, taken in conjunction with the accompanying drawings and the preceding background.

BRIEF SUMMARY

A thermal isolating service tube for a gas turbine engine is provided. In accordance with one exemplary embodiment, the thermal isolating service tube comprises an inner tubular member defining a fluid passage and at least one outer tubular member disposed about the inner tubular member. A spacing volume is defined between at least the inner tubular member and an adjacent outer tubular member. The thermal isolating service tube comprises a unitary structure and has at least one portion with a curved configuration, a non-circular cross-sectional shape, or both.

A service tube assembly is provided in accordance with yet another exemplary embodiment of the present invention. The service tube assembly comprises an external structure having a non-cylindrical opening therethrough and a unitary thermal isolating service tube. The unitary thermal isolating service tube comprises an inner tubular member defining a fluid passage and at least one outer tubular member disposed about the inner tubular member to define a spacing volume therebetween. At least one portion of the thermal isolating service tube is configured with a non-circular cross-sectional shape and dimensioned to pass through the non-cylindrical opening.

A gas turbine engine is provided in accordance with yet another exemplary embodiment of the present invention. The gas turbine engine comprises a rotor bearing in a bearing sump of the gas turbine engine, and an oil system for lubricating and cooling the rotor bearing with oil when the gas turbine engine is operating. The oil system comprises a plurality of service tubes, at least one service tube of the plurality of service tubes comprising a thermal isolating service tube. The thermal isolating service tube comprises an inner tubular member defining a fluid passage and at least one outer tubular member disposed about the inner tubular member. A spacing volume is defined between at least the inner tubular member and an adjacent outer tubular member. The thermal isolating service tube comprises a unitary structure and at least one portion with a curved configuration, a non-circular cross-sectional shape, or both.

Furthermore, other desirable features and characteristics of the thermal isolating service tubes and assemblies thereof for gas turbine engines will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various embodiments are directed to thermal isolating service tubes and assemblies thereof, and gas turbine engines including the same. The thermal isolating service tubes and assemblies thereof allow adequate thermal growth and stress compliance during transient and steady state operating conditions. The terms "compliant" and "compliance" as used herein refer to the ability of the thermal isolating service tube to absorb and attenuate relative motions to eliminate concentrated stress, thereby minimizing the negative effects of thermo-mechanical fatigue (TMF) during gas turbine engine operation. The thermal isolating service tube comprises a unitary structure. As used herein, the term "unitary" means a one-piece configuration such that the unitary structure excludes brazing, fasteners, or the like for maintaining parts in a fixed relationship as a single unit. The term "thermal isolating" refers to substantial thermal isolation between a fluid adapted to flow within an inner tubular member of the thermal isolating service tube and a medium externally adjacent to the thermal isolating service tube. As a result of the service tube being "thermal isolating", heat loads and coking of the thermal isolating service tube are reduced, resulting in reduced bearing and engine maintenance, increased bearing and engine life, reduced heat rejection requirements, and reduced engine overhaul and removals. In addition, the thermal isolating service tubes for gas turbine engines in accordance with exemplary embodiments are more easily routed within the stationary structural frame of the gas turbine engine.

Figure 1:
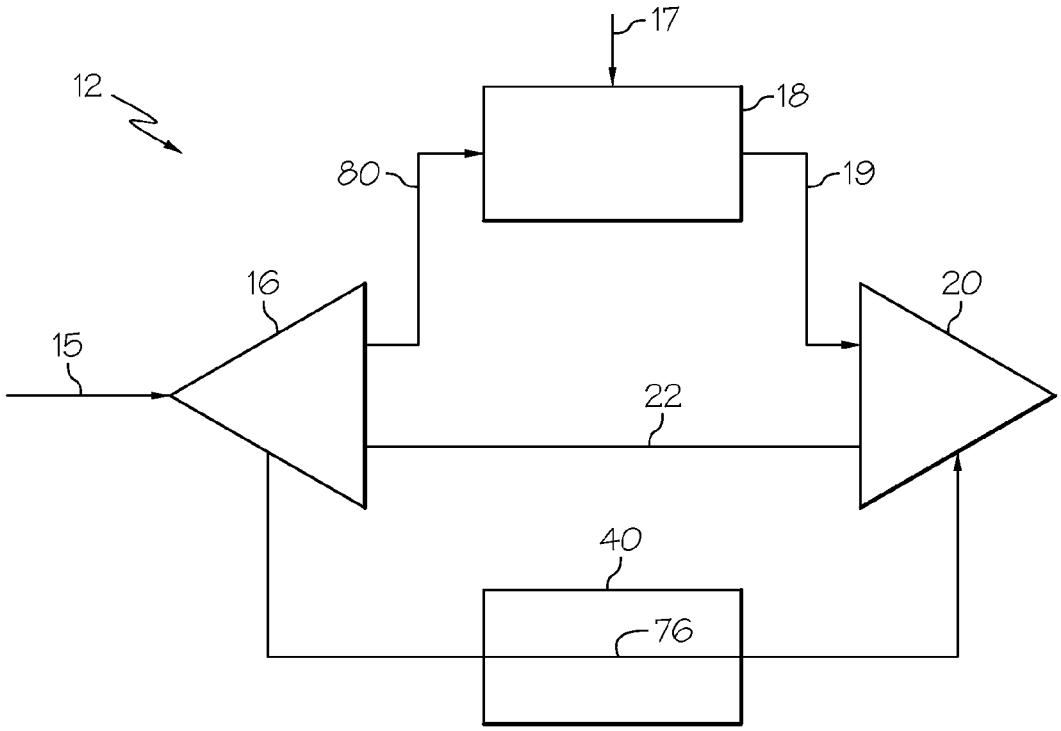
FIG. 1 is a simplified schematic illustration of a gas turbine engine.

FIG. 1 is a simplified schematic illustration of a gas turbine engine 12 including a compressor 16, a combustor 18, and a turbine 20. The compressor 16, combustor 18, and turbine 20 are in flow communication. Compressor 16 and turbine 20 are coupled by a shaft 22. Shaft 22 rotates about an axis of symmetry, which is the centerline of the shaft 22. In operation, air 15 flows through the compressor 16 and compressed inlet air 80 is supplied from compressor 16 to combustor 18 and is then mixed with fuel 17 provided by fuel nozzles (not shown) and ignited within the combustor 18 to produce hot combustion gases 19. The hot combustion gases 19 drive turbine 20. Intermediate pressure cooling air 76 flows from the compressor 16 to the turbine 20 through a cooling circuit 40 to cool the turbine components. It is to be understood that only one compressor and one turbine are shown for ease of illustration, but multiple compressors and turbines may be present in the gas turbine engine.

The shaft 22 is mounted for rotation in one or more rotor bearings 23 each located in a bearing sump. One such bearing sump is identified at 25 in FIG. 2. The gas turbine engine comprises an oil system 300 (FIG. 2) for lubricating and cooling the rotor bearing in the bearing sump with oil when the gas turbine engine is operating. The oil system supplies the oil to lubricate and cool the rotor bearing in the bearing sump of the gas turbine engine. The bearing sump 25 is pressurized by air flowing into the bearing sump through a labyrinth seal in order to prevent oil leakage and is vented through a scavenge system (not shown) whereby the oil is returned to the tank for reuse.

Figure 2:
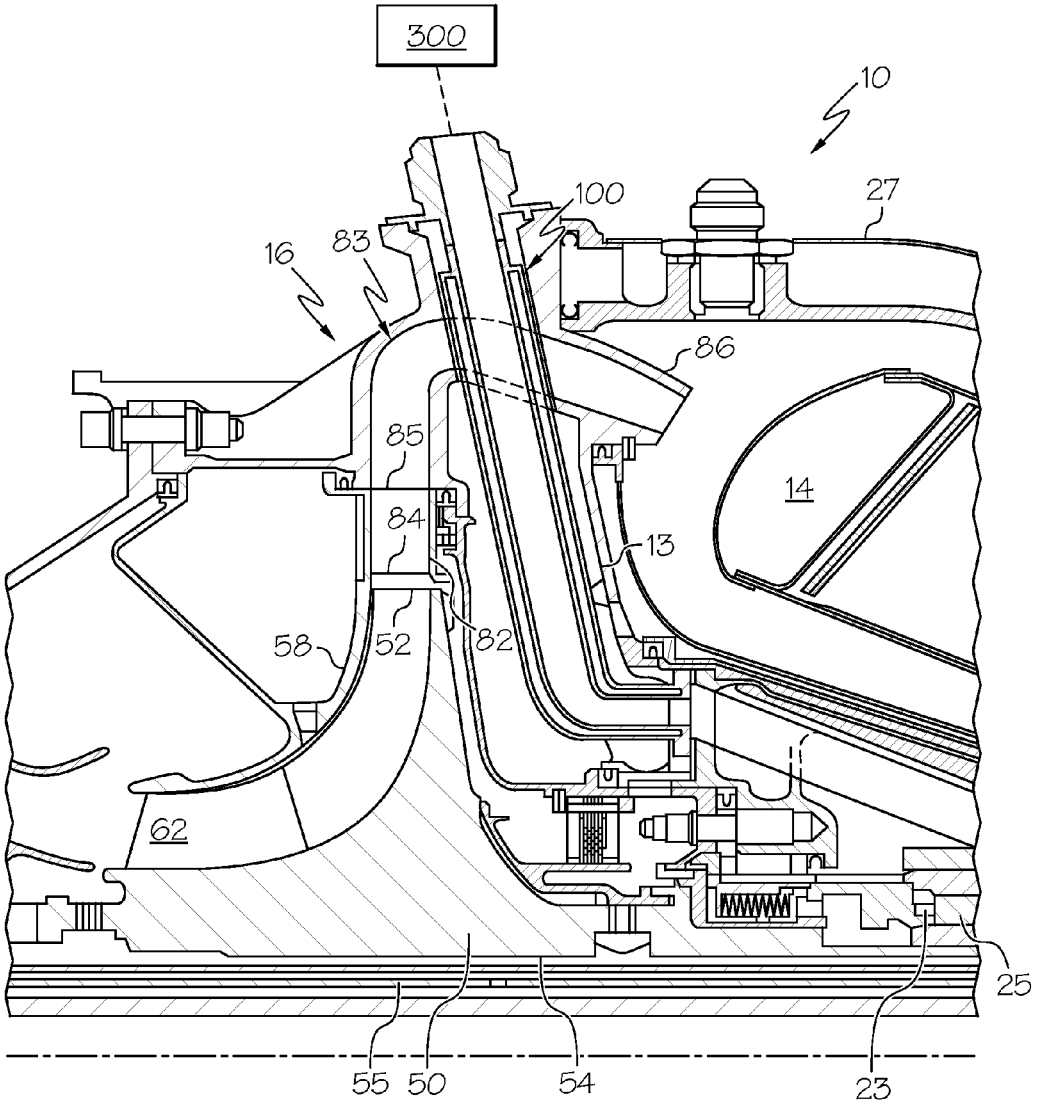
FIG. 2 is a side cross-sectional view of an aft portion of the gas turbine engine of FIG. 1, showing the area around a bearing sump in detail, according to an exemplary embodiment of the present invention.

FIG. 2 is a side cross-sectional schematic illustration of an aft portion of the gas turbine engine 12 including the exemplary compressor 16 and the area around the bearing sump, including one or more stationary structural frames 13. One such stationary structural frame is identified at 13 in FIG. 2. The one or more structural frames provide structural load paths from the rotor bearings 23 to an outer casing 27, which forms a backbone structure of the gas turbine engine. A plurality of hollow service tubes are routed within the stationary structural frame and carry fluids to and from the oil system 300. More specifically, the hollow service tubes may be used to transport air or oil from the area between the bearing sump and an external conduit (not shown), such as an oil supply or scavenge line, or sump pressurization or vent line, which is coupled to the end of the service tube. The hollow service tubes supply oil to the bearing sump, drain spent oil from the bearing sump, pressurize the bearing sump with air, and vent air from the bearing sump. At least one service tube of the plurality of service tubes comprises a thermal isolating service tube in accordance with exemplary embodiments, as hereinafter described. One thermally isolating service tube is identified generically at 100 in FIG. 2.

The stationary structural frame 13 crosses the compressor gas flowpath of the turbine and is thus exposed to hot compressor gases 80 (FIG. 1) in operation.

Figure 8:
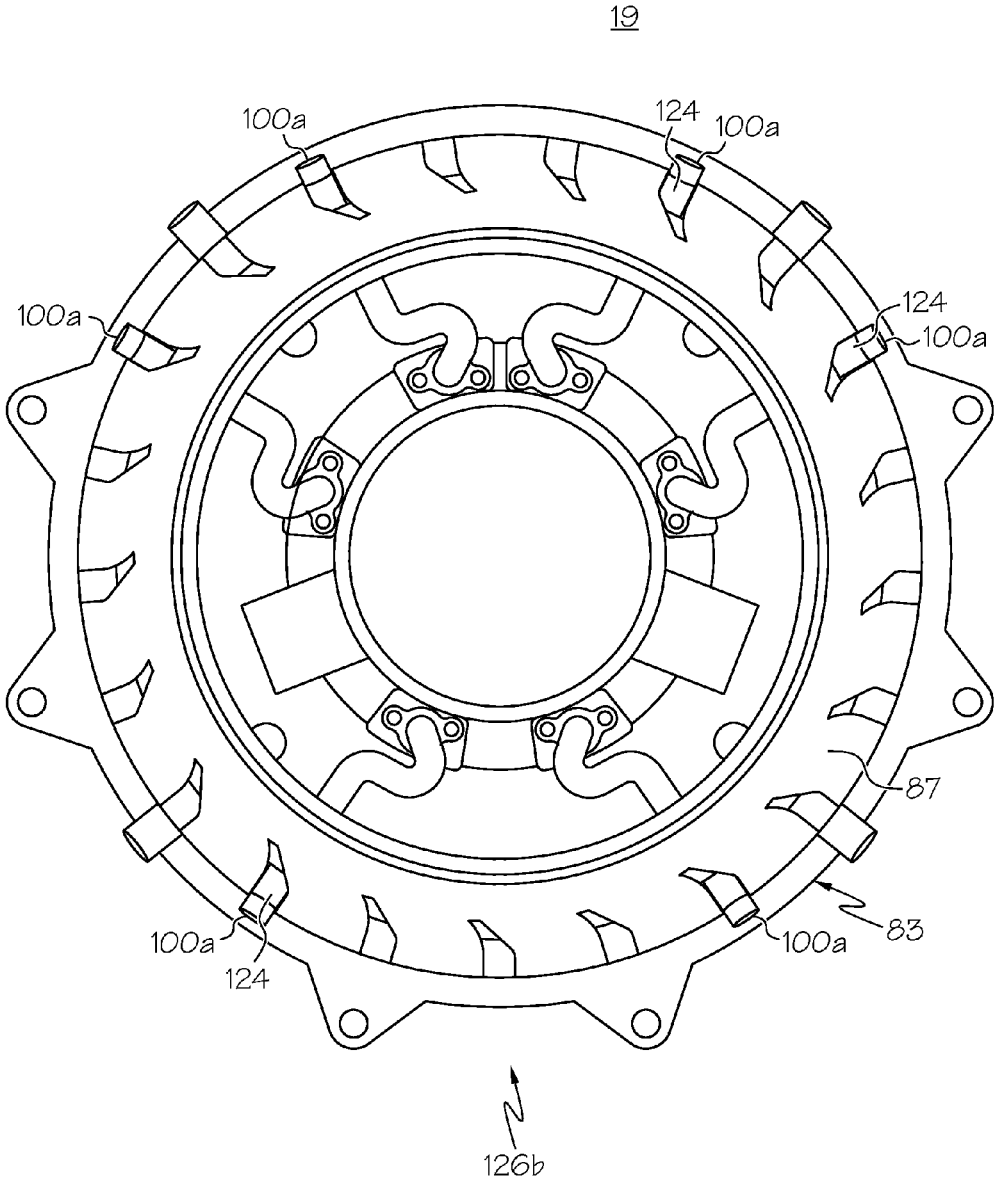
FIG. 8 is a side view of an exemplary service tube assembly including a diffuser housing and a plurality of thermal isolating service tubes, according to another exemplary embodiment of the present invention.

Still referring to FIG. 2, compressor 16 includes a centrifugal compressor, or impeller 50, and the cooling circuit 40 (not shown in FIG. 2). The centrifugal compressor/impeller 50 includes an impeller inlet 62, an impeller exit 52, and a hub 54. The impeller 50 and an impeller shroud 58 extend radially outward from the impeller inlet 62 to the impeller exit 52. Impeller hub 54 is coupled circumferentially to a rotor shaft 55. The combustor 18 (not shown in FIG. 2) is positioned downstream from the compressor 16 and the turbine 20 (not shown in FIG. 2) is coupled coaxially with compressor 16 downstream from combustor 18. The turbine 20 is in flow communication with the combustor 18. The impeller exit 52 is in flow communication with a diffuser 82. Diffuser 82 is positioned radially outward from the centrifugal compressor 50 and includes a diffuser inlet 84 and a diffuser outlet 85. Diffuser 82 is disposed within a diffuser housing 83 (illustrated in more detail in FIG. 8). The illustrated diffuser housing 83 has sides (only one side 87 is shown in FIG. 8) and openings 124 arranged circumferentially in a side thereof. The diffuser housing is in contact with the hot compressor gas 80 (FIG. 1). Diffuser inlet 84 is adjacent the impeller exit 52 and permits compressed inlet air 80 (FIG. 1) to exit centrifugal compressor/impeller 50 into diffuser 82. A deswirl cascade 86 is in flow communication with diffuser 82 and extends from diffuser outlet 85. During operation of the gas turbine engine, inlet air 15 (FIG. 1) enters compressor 16 and is compressed by the plurality of compressor stages (not shown) prior to entering the centrifugal compressor 50. Compressed inlet air 80 exiting diffuser 82 passes serially through the deswirl cascade 86 to mix with fuel 17 (FIG. 1) provided by fuel nozzles (not shown) and ignited within the combustor 18 (FIG. 1) to produce hot combustion gases 19 (FIG. 1). The resulting hot combustion gases drive the turbine 20 (FIG. 1).

Figure 3A:
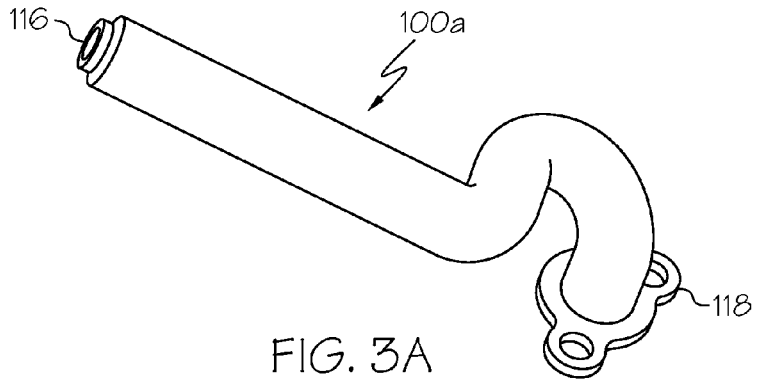
FIG. 3A is an isometric view (in isolation) of a portion of an exemplary thermal isolating service tube used in the gas turbine engine of FIG. 1, according to an exemplary embodiment of the present invention.
Figure 3B:
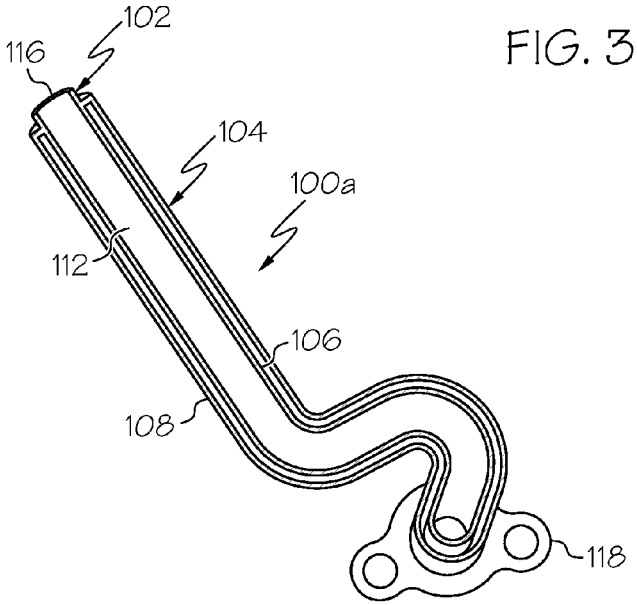
FIG. 3B is a cross-sectional view of the exemplary thermal isolating service tube of FIG. 3A.
Figure 3C:
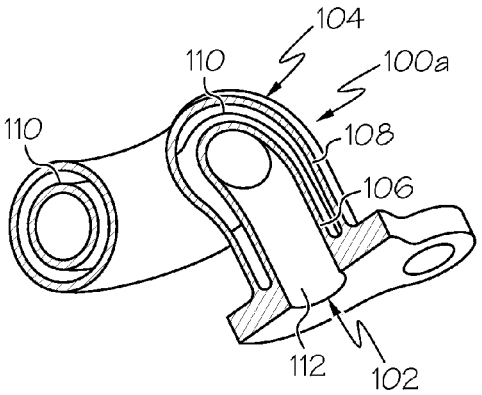
FIG. 3C is a cross-sectional view of an end portion of the exemplary thermal isolating service tube of FIGS. 3A and 3B.

Referring now to FIGS. 3A through 3C, according to exemplary embodiments, the thermal isolating service tube 100 in FIG. 2 (identified as exemplary thermal isolating service tube 100*a* in FIGS. 3A through 3C) comprises a plurality of tubular members disposed around each other. Each of the tubular members is hollow. The plurality of tubular members may be substantially concentric, partially eccentric, fully eccentric, or combinations thereof. The plurality of tubular members comprises an inner tubular member 102 defining a fluid passage and at least one outer tubular member 104 disposed about the inner tubular member. The inner tubular member 102 has an inner tubular member wall 106 and the at least one outer tubular member 104 has an outer tubular member wall 108. A spacing volume 110 is defined between the inner tubular member wall 106 and the adjacent outer tubular member wall 108. A spacing volume may also be defined between at least one pair of outer tubular member walls (if there is more than one outer tubular member), as hereinafter described. While the exemplary illustrated thermal isolating service tube 100*a* of FIGS. 3A through 3C has only two tubular members (the inner tubular member and a single outer tubular member), it is to be understood that the thermal isolating service tube 100 may have more than two tubular members.

Figure 4:
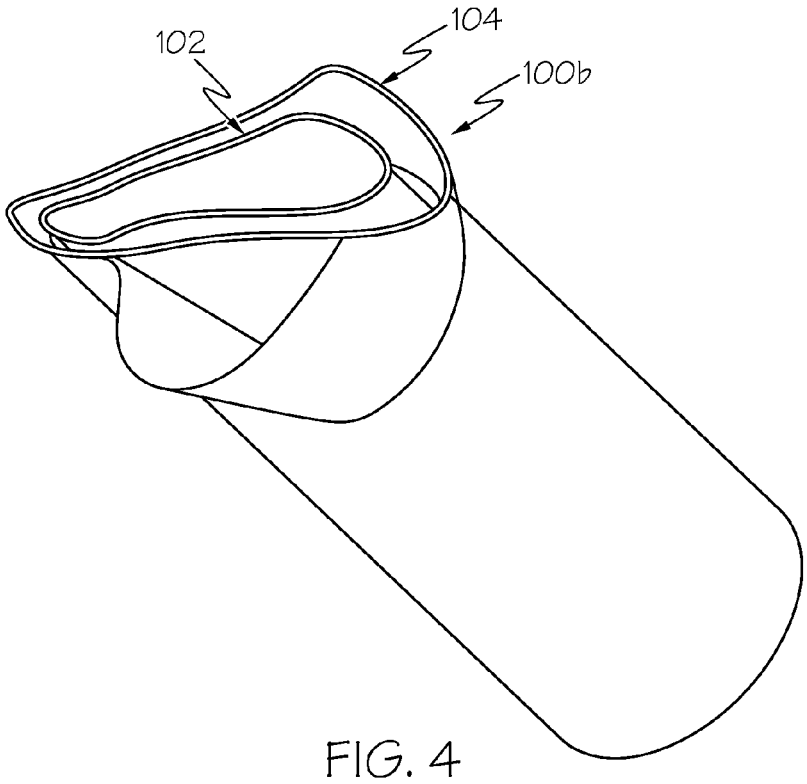
FIG. 4 is an isometric view (in isolation) of a portion of another exemplary thermal isolating service tube, according to an exemplary embodiment of the present invention.

The thermal isolating service tube 100 (exemplified as thermal isolating service tube 100*a* through 100*c*) comprises a unitary structure having at least one portion with a curved configuration (e.g., FIGS. 3A through 3C and FIG. 8), a non-circular cross-sectional shape (e.g., FIG. 4), or both. The inner tubular member 102 may have a cross-sectional shape that is the same as the cross-sectional shape of the at least one outer tubular member 104. In other embodiments, the cross-sectional shape of the inner tubular member 102 may be different from the cross-sectional shape of the at least one outer tubular member 104. The cross-sectional shape of the outer tubular members may be the different or the same from each other.

The curved configuration may comprise a uniform curved configuration or a non-uniform curved configuration. For example, FIGS. 3A through 3C depict a thermal isolating service tube 100*a* having a non-uniform curved configuration, e.g. the thermal isolating service tube may curve in a number of directions. The non-circular cross-sectional shape may be any cross-sectional shape, such as the cross-sectional shape of a portion of the exemplary thermal isolating service tube 100*b* of FIG. 4 or the arcuate cross-sectional shape of thermal isolating service tube in the service tube assembly of FIG. 6, or any other cross-sectional shape that is not circular. The thermal isolating service tube may have the at least one portion with the non-circular cross-sectional shape and an adjacent portion with a circular cross-sectional shape (i.e., the adjacent portion is cylindrical) (e.g., FIG. 6). In another embodiment, the thermal isolating service tube may have the at least one portion with the non-circular cross-sectional shape and an adjacent portion with a different non-circular cross-sectional shape. The thermal isolating service tube may change cross-sectional shape from substantially concentric circular cross-sectional shapes to non-circular, eccentric cross-sectional shapes.

As noted previously, a spacing volume 110 is defined between at least the inner tubular member 102 and the adjacent outer tubular member 104. A spacing volume may also be defined between at least one pair of outer tubular member walls (if there is more than one outer tubular member 104). The inner tubular member defines a flow passage 112 for fluid (generally oil or air). The spacing volume(s) 110 thermally isolate the fluid that is adapted to flow within the inner tubular member 102 from a medium (e.g., hot combustion gases 19 (FIGS. 1, 6, and 8)) adjacent, to the thermal isolating service tube and/or a surrounding external structure, as hereinafter described. The spacing volume 110 between the tubular members may be constant or may vary depending upon the cross-sectional shape of the tubular member. The at least one outer tubular member 104 may be evenly spaced, unevenly spaced, or combinations thereof, relative to other tubular members. In an embodiment, cooling fluid (e.g., cooling air) may be passed through the spacing volume 110 between the inner tubular member 102 and the adjacent outer tubular member 104, between at least one pair of outer tubular member walls, or both. In other embodiments, there is no cooling air passed through any of the spacing volume(s).

The thermal isolating service tube 100 (exemplified by thermal isolating service tubes 100*a* through 100*c*) comprising the unitary structure may have at least one cylindrical end portion 116 (e.g., FIGS. 3A and 3B) configured for connection with a common fitting such as a coupling member (not shown). For example, the thermal isolating service tube may be coupled by a coupling member to an oil supply portion (not shown) of the oil system 300 of the gas turbine engine 10 (FIGS. 1 and 2), coupled to a scavenge portion (not shown) of the oil system, etc. Airflow to pressurize the bearing sump and vent air flow therefrom may also be provided through thermal isolating service tubes in accordance with exemplary embodiments.

Figure 10:
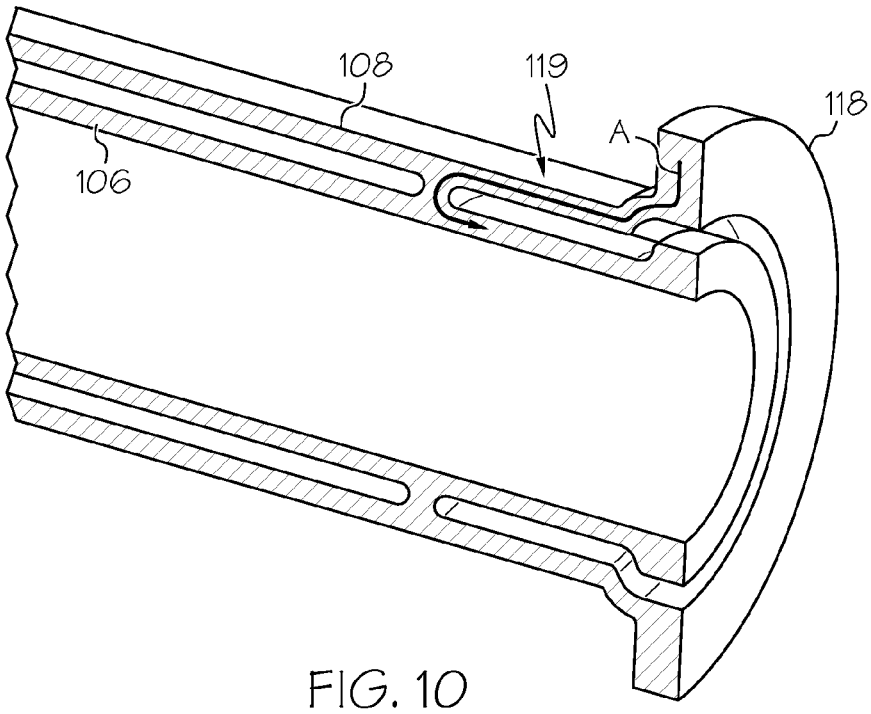
FIG. 10 is a cross-sectional view of an end portion of an exemplary thermal isolating service tube terminating in a mounting flange.
Figure 11:
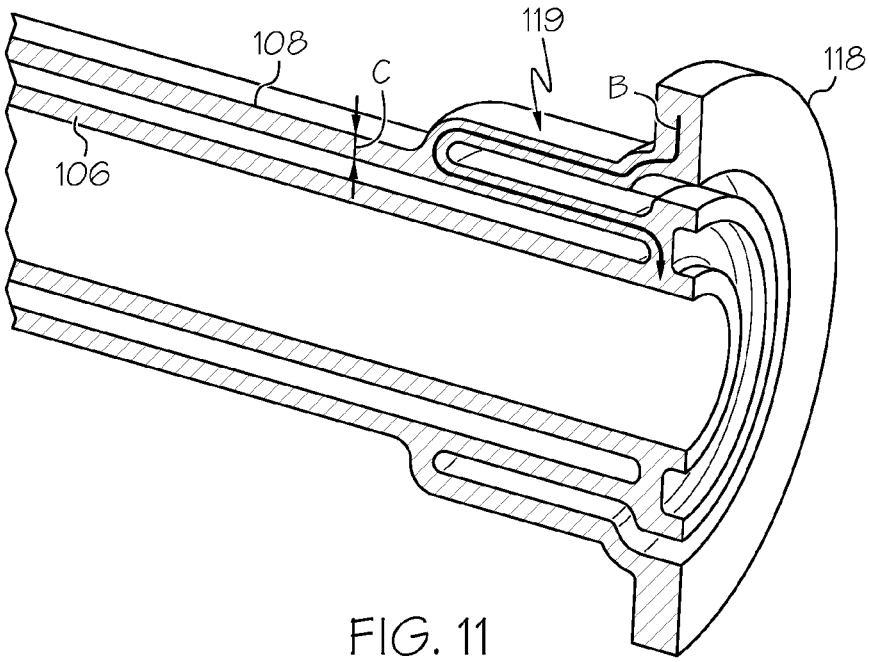
FIG. 11 is another cross-sectional view similar to FIG. 10, illustrating the end portion and mounting flange of another exemplary thermal isolating service tube.

Referring now to FIGS. 10 and 11, in another embodiment, at least one end portion of the outermost outer tubular member 104 of thermal isolating service tube 100 may terminate in a mounting flange 118 that is substantially thermally isolated from the inner tubular member 102 by a series of walls 119 to define a heat flow path (identified in FIG. 10 with an arrow A and in FIG. 11 with an arrow B). The series of walls 119 may include outer tubular member wall 108. The length of the heat flow path between the mounting flange and the inner tubular member substantially determines the extent of thermal isolation between the inner tubular member and the mounting flange. The thermal isolating service tube is configured to be attached to a mounting surface by the mounting flange. The mounting surface and the mounting flange may be exposed to high temperatures from which the fluid flowing through the inner tubular member of the thermal isolating service tube is ideally thermally isolated. Thermal isolation reduces heat conduction into the inner tubular member and thus into the fluid. As the heat flow path A in FIG. 10 is shorter (because of fewer walls in the series of walls 119) than heat flow path B in FIG. 11, the thermal isolation between the mounting flange and the inner tubular member is greater in the exemplary thermal isolating service tube depicted in FIG. 11 relative to the exemplary thermal isolating service tube depicted in FIG. 10. In an embodiment, wall thickness (identified in FIG. 11 with double headed arrow C) may be decreased to alternatively or additionally decrease the heat flow between the mounting flange 118 and the inner tubular member 102. While the wall thickness C of outer tubular member wall 108 is identified in FIG. 11 as subject to decrease, it is to be understood that the thickness of any of the walls comprising the series of walls 119 may be decreased to alternatively or additionally decrease the heat flow between the mounting flange and the inner tubular member.

Figure 5:
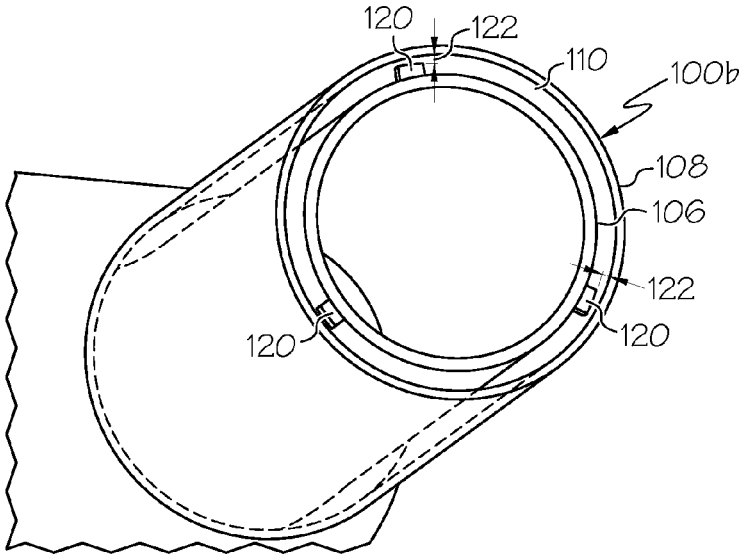
FIG. 5 is a cross-sectional view of a portion of the thermal isolating service tube of FIG. 4, illustrating a plurality of (exemplary) spacers extending between an exterior surface of an inner tubular member wall and an interior surface of an outer tubular member wall, according to an exemplary embodiment of the present invention.

As depicted in FIG. 5, in accordance with exemplary embodiments, the thermal isolating service tube 100 (as exemplified by thermal isolating service tube 100*b*) may further comprise at least one spacer 120 that partially extends radially between an exterior surface of the inner tubular member wall 106 and an interior surface of the (adjacent) outer tubular member wall 108, in the spacing volume 110 between the inner tubular member 102 and the adjacent outer tubular member 104. The at least one spacer "partially extends" by being unitary with one of the inner tubular member wall 106 or adjacent outer tubular member wall 108 with a small gap 122 at the opposite wall. The gap 122 is dimensioned such that substantial alignment is maintained between the tubular members. While the at least one spacer is depicted in FIG. 5 between the inner tubular member and the adjacent outer tubular member, it is to be understood that the at least one spacer may additionally or alternatively be positioned between outer tubular members. The at least one spacer may be axially positioned along the length of the thermal isolating service tube wherever needed for retaining substantial alignment between tubular members. The at least one spacer 120 retains substantial alignment between the tubular members of the thermal isolating service tube during gas turbine engine operation. In addition, the at least one spacer helps maintain thermal isolation between fluid adapted to flow in the inner tubular member and the medium (e.g., hot combustion gas 19) external to an external structure (exemplified as a flow path vane or structural frame strut 115 in FIGS. 6 and 7) as hereinafter described. While three circumferentially, substantially equispaced, radial spacers are illustrated in FIG. 5, it is to be understood that a fewer or greater number of spacers may be used, the at least one spacer may be spaced in arrangements other than as depicted, and the at least one spacer may be configured other than as depicted (e.g., a circumferential ring). While at least one spacer is depicted with thermal isolating service tube 100*b*, it is to be understood that exemplary thermal isolating service tubes 100*a* and/or 100*c* may further comprise the at least one spacer 120.

Figure 6:
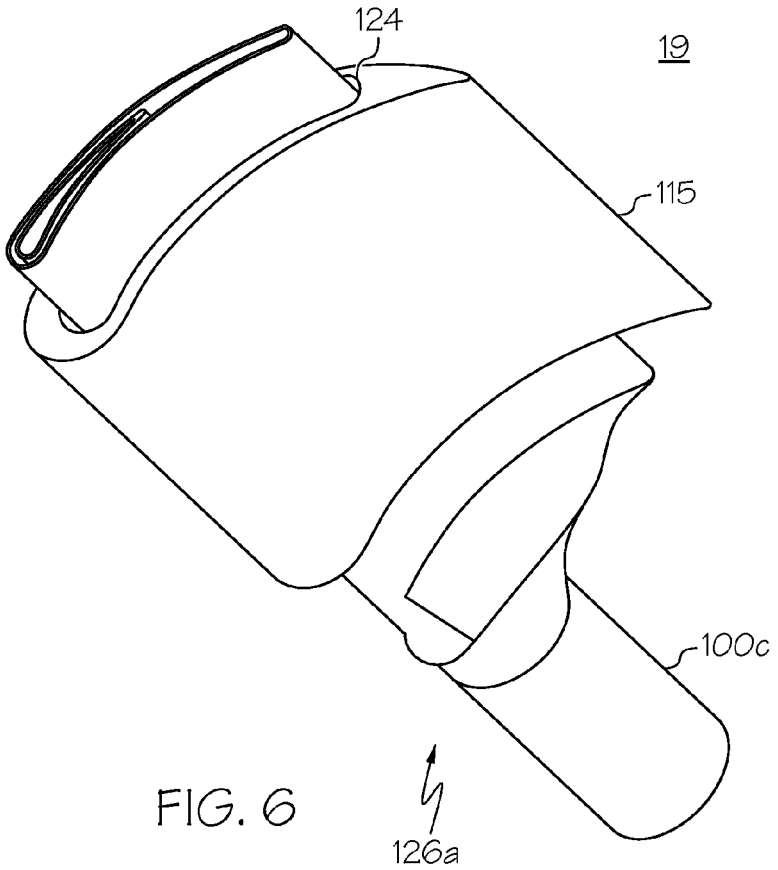
FIG. 6 is an isometric view of an exemplary service tube assembly, according to an exemplary embodiment of the present invention.
Figure 7:
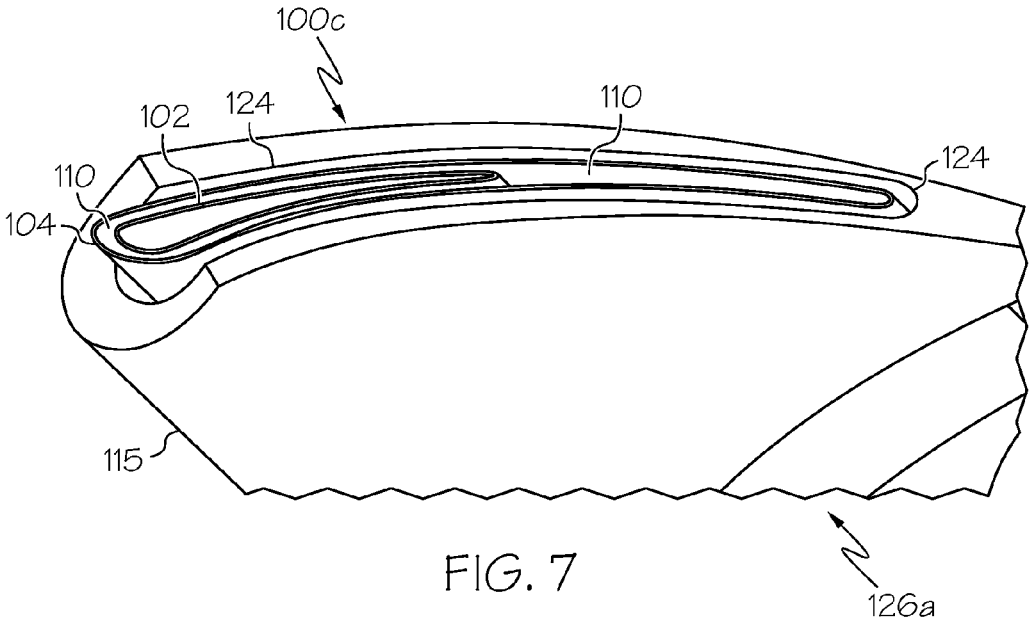
FIG. 7 is a partial cross-sectional view of a portion of the exemplary service tube assembly of FIG. 6.
Figure 12:
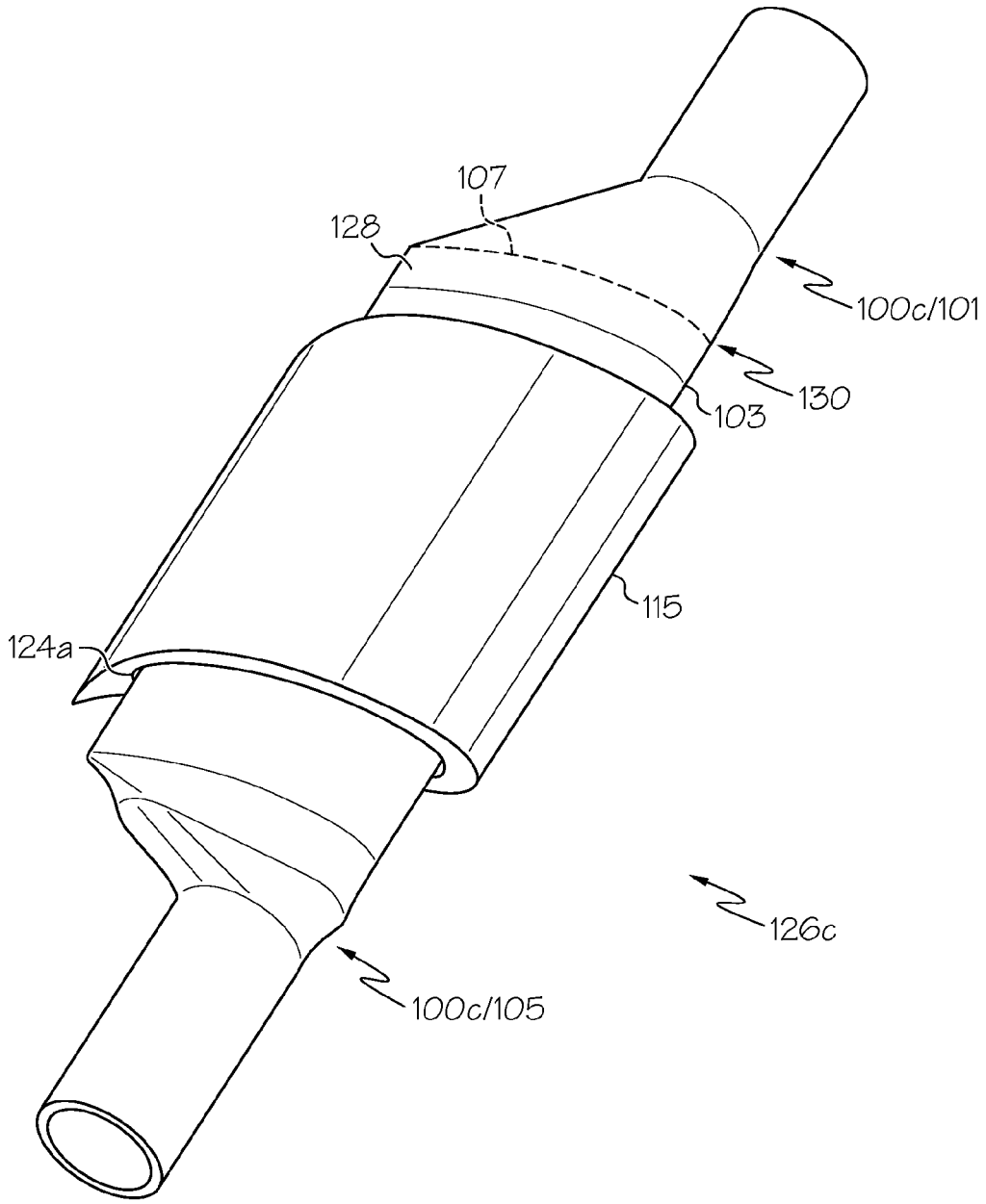
FIG. 12 is an isometric view of an exemplary service tube assembly including an exemplary brazed tube assembly, according to another exemplary embodiment of the present invention.

Referring now to FIGS. 6 and 7, in accordance with exemplary embodiments, the thermal isolating service tube 100 (FIG. 2) (as exemplified by thermal isolating service tube 100*c* in FIGS. 6 and 7) may extend through an opening 124 in the external structure (the external structure exemplified by the flow path vane or strut 115 in FIGS. 6 and 7 and FIG. 12, respectively), the external structure 115 and the at least one thermal isolating service tube comprising a service tube assembly (exemplified by service tube assembly 126*a* in FIGS. 6 and 7). In an embodiment, the thermal isolating service tube is configured and dimensioned to pass through the non-cylindrical opening 124 in the external structure. More specifically, the at least one portion (having the non-circular cross-sectional shape) of the thermal isolating service tube is configured and dimensioned (hereinafter "a configured and dimensioned portion") to pass through the non-cylindrical opening in the external structure. The non-cylindrical opening in the external structure has substantially the same cross-sectional shape as the non-circular cross-sectional shape of the at least one configured and dimensioned portion of the thermal isolating service tube. As seen best in FIG. 7, the cross-sectional size of the inner tubular member does not have to be the same cross-sectional size as the cross-sectional size of the outer tubular member or the at least one portion of the thermal isolating service tube. The external structure may be a fairing, the structural frame or a portion thereof (e.g., a flow path vane or strut), a diffuser housing, or the like. For example, FIGS. 6 and 7 depict a representative service tube assembly 126*a*. The representative service tube assembly comprises an exemplary thermal isolating service tube 100*c* that passes through an airfoil-shaped opening in the external structure. The configured and dimensioned portion of the tube has a non-circular arcuate-shaped cross-sectional shape having substantially the same cross-sectional shape and size as the airfoil-shaped opening 124 in the external structure. The external structure defines a continuous fairing around the configured and dimensioned portion of the thermal isolating service tube. The non-cylindrical opening in the external structure has substantially the same cross-sectional size and shape as the configured and dimensioned portion of the thermal isolating service tube. The tube has an irregular-shaped cross-section defined by integrally connected non-circular and circular cross-sectional portions having a smooth transition therebetween, i.e., the unitary thermal isolating service tube has the at least one (configured and dimensioned) portion with the non-circular cross-sectional shape (here, the air-foil cross-sectional shape) and an adjacent portion with a circular cross-sectional shape. Thus, the thermal isolating service tube transitions from an irregularly-shaped cross section to a circular cross-section while maintaining a multiple wall structure. The fluid adapted to flow in the inner tubular member of the thermal isolating service tube is thermally isolated from the medium (e.g., hot combustion gas 19 (FIG. 6)) externally adjacent to the external structure.

FIG. 8 depicts another representative service tube assembly 126*b* comprising the external structure (in this case, the diffuser housing 83 of FIG. 2) and a plurality of thermal isolating service tubes (exemplified by thermal isolating service tubes 100*a* of FIGS. 3A through 3C). As noted previously, each thermal isolating service tube of the plurality of thermal isolating service tubes 100*a* has at least one portion having a curved configuration and a non-circular cross-sectional shape (the non-circular cross-sectional shape is not shown in FIG. 8). The at least one portion having the non-circular cross-sectional shape passes through the non-cylindrical openings 124 (that the opening is non-cylindrical is not shown in FIG. 8) in the side 87 of the diffuser housing 83. As noted previously, the diffuser housing is in contact with hot compressor gas 80 (FIG. 1). The exemplary thermal isolating service tubes 100*a* pass through the openings 124 in the side 87 of the diffuser housing 83 to transport fluid to/from the bearing sump 25 (FIG. 2) and thermally isolate the fluid flowing through the inner tubular member of the thermal isolating service tubes 100*a* from the hot compressor gas 80 contacting the diffuser housing 83. As the thermal isolating service tube(s) may pass through opening(s) 124 in the external structure itself, the external structure no longer presents routing challenges, i.e., the external structure (e.g., the structural frame, the diffuser housing, etc.) is no longer an obstacle to routing of the service tubes.

Figure 13:
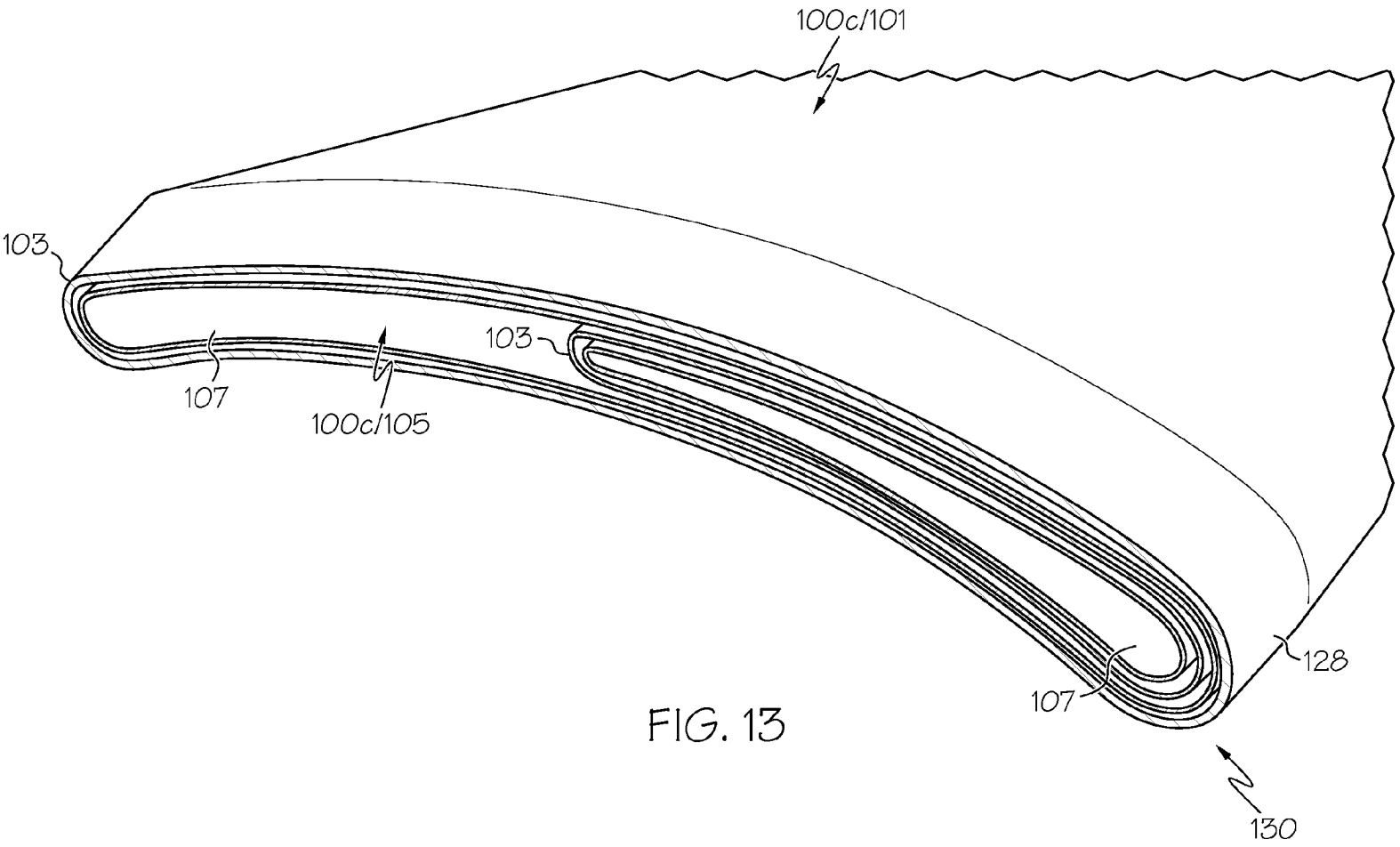
FIG. 13 is an enlarged partial view of a portion of the exemplary brazed tube assembly of FIG. 12.

Referring now to FIGS. 12 and 13, according to another exemplary embodiment, a pair of the thermal isolating service tubes 100*c* (FIGS. 6 and 7)) are brazed together to form a brazed tube assembly 130. More specifically, the pair of thermal isolating service tubes 100*c* comprises a first thermal isolating service tube 101 having a first end portion 103 and a second thermal isolating service tube 105 having a second end portion 107, the first and second end portions 103 and 107 brazed together at a braze joint 128, thereby forming the brazed tube assembly 130. The brazed tube assembly may be included in a service tube assembly 126*c* as depicted in FIG. 12. Service tube assembly 126*c* comprises the external structure (exemplified by flow path vane or strut 115 of stationary structural frame 13 (FIG. 2)) (having the non-cylindrical opening 124 through which a thermal isolating service tube 100*c* (of the brazed tube assembly 130) passes. FIG. 13 is an enlarged partial view of the braze joint 128 between the pair of thermal isolating service tubes 100*c*. The braze joint 128 comprises the first end portion 103 of thermal isolating service tube 100*c*/101 and the mating second end portion 107 of thermal isolating service tube 100*c*/105 of the pair of thermal isolating service tubes. The braze joint 128 may be constructed as a sliding joint so that the first end portion 103 of tube 100*c*/101 slides over the second end portion 107 of tube 100*c*/105. It should be understood that the second end portion 107 of tube 100*c*/105 may alternatively slide over the first end portion 103 of tube 100*c*/101. It should also be understood that while thermal isolating service tubes 100*c* are brazed together, other thermal isolating service tubes may be brazed together and a single thermal isolating service tube 100*c* may be brazed to a different thermal isolating service tube (e.g., thermal isolating service tubes 100*a* or 100*b*).

It will be appreciated that the presently described service tubes would be expensive or impossible to manufacture using conventional manufacturing techniques. As such, designs in accordance with the present disclosure are not known in the prior art. However, the present inventors have discovered that using additive manufacturing techniques, or other recently developed manufacturing techniques, designs in accordance with the present disclosure can be manufactured at a significantly reduced cost as compared to traditional manufacturing techniques. Additive manufacturing techniques include, for example, direct metal laser sintering (DMLS—a form of direct metal laser fusion (DMLF)) with nickel base super-alloys, low density titanium, and aluminum alloys. DMLS is discussed in greater detail below. Another technique includes electron beam melting (EBM) with titanium, titanium aluminide, and nickel base super-alloy materials. Still further, casting or metal injection molding (MIM) may be employed.

The thermal isolating service tubes 100 (as exemplified by thermal isolating service tubes 100*a* through 100*c*) may be manufactured using additive manufacturing techniques. The tubes may be manufactured using additive manufacturing techniques. Additive manufacturing techniques may begin with providing a model, such as a design model, of the thermal isolating service tube. The model may be defined in any suitable manner. For example, the model may be designed with computer aided design (CAD) software and may include three-dimensional ("3D") numeric coordinates of the entire configuration of the tubes including both external and internal surfaces. In one exemplary embodiment, the model may include a number of successive two-dimensional ("2D") cross-sectional slices that together form the 3D component.

The thermal isolating service tube is formed according to the model, using a rapid prototyping or additive layer manufacturing process. Some examples of additive layer manufacturing processes include: micro-pen deposition in which liquid media is dispensed with precision at the pen tip and then cured; selective laser sintering in which a laser is used to sinter a powder media in precisely controlled locations; laser wire deposition in which a wire feedstock is melted by a laser and then deposited and solidified in precise locations to build the product; electron beam melting; laser engineered net shaping; and direct metal deposition. In general, additive manufacturing techniques provide flexibility in free-form fabrication with few or no geometric constraints, fast material processing time, and innovative joining techniques. In one particular exemplary embodiment, direct metal laser fusion (DMLF) may be used to produce the multi-walled unitary tube. DMLF is a commercially available laser-based rapid prototyping and tooling process by which complex parts may be directly produced by precision melting and solidification of metal powder into successive layers of larger structures, each layer corresponding to a cross-sectional layer of the 3D component. DMLF may include direct metal laser sintering (DMLS), as previously noted.

Figure 9:
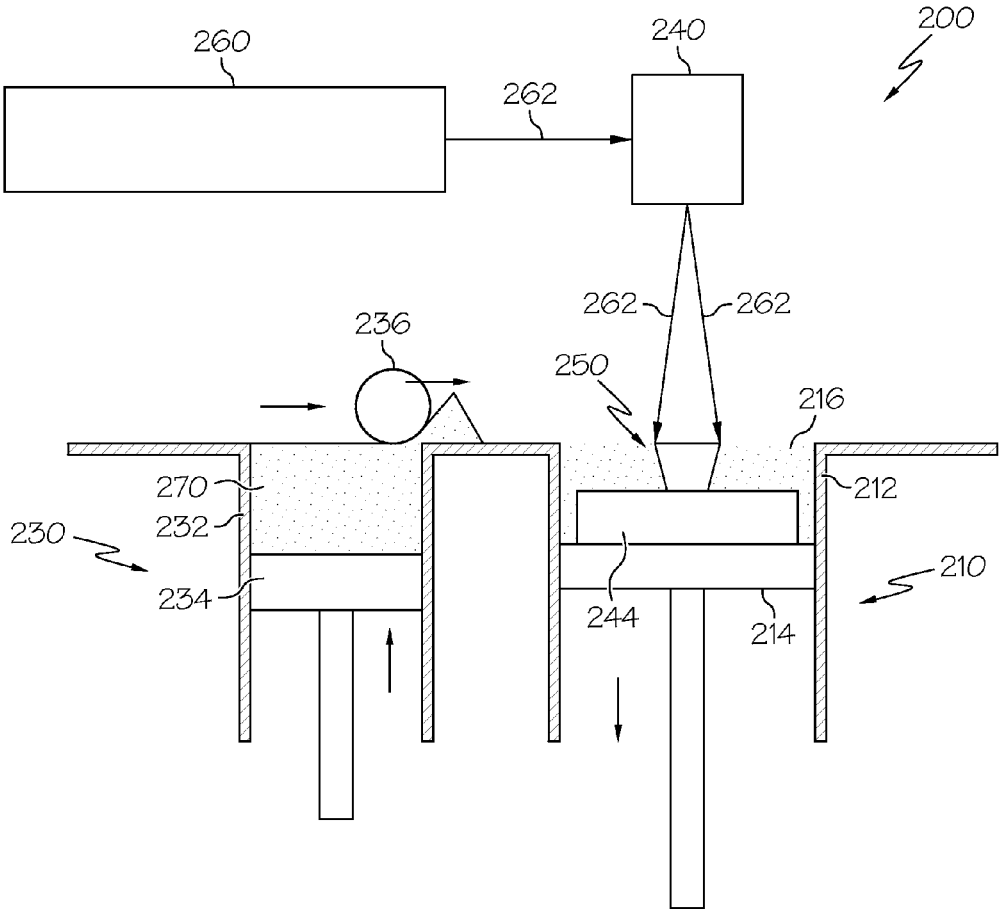
FIG. 9 is a schematic view of an exemplary direct metal laser fusion (DMLF) system for manufacturing the thermal isolating service tube according to exemplary embodiments.

FIG. 9 is a schematic view of an exemplary DMLF system 1200 for manufacturing the thermal isolating service tube 100 as shown in FIG. 1 (and exemplified as thermal isolating service tubes 100*a* through 100*c* in FIGS. 3A through 8) in accordance with an exemplary embodiment. The system 200 includes a fabrication device 210, a powder delivery device 230, a scanner 240, and a laser 260 that function to manufacture the article 250 (e.g., the thermal isolating service tube) with build material 270. The fabrication device 210 includes a build container 212 with a fabrication support 214 on which the article 250 is formed and supported. The fabrication support 214 is movable within the build container 212 in a vertical direction and is adjusted in such a way to define a working plane 216. The delivery device 230 includes a powder chamber 232 with a delivery support 234 that supports the build material 270 and is also movable in the vertical direction. The delivery device 230 further includes a roller or wiper 236 that transfers build material 270 from the delivery device 230 to the fabrication device 210.

During operation, a base block 244 may be installed on the fabrication support 214. The fabrication support 214 is lowered and the delivery support 234 is raised. The roller or wiper 236 scrapes or otherwise pushes a portion of the build material 270 from the delivery device 230 to form the working plane 216 in the fabrication device 210. The laser 260 emits a laser beam 262, which is directed by the scanner 240 onto the build material 270 in the working plane 216 to selectively fuse the build material 270 into a cross-sectional layer of the article 250 according to the design. More specifically, the speed, position, and other operating parameters of the laser beam 262 are controlled to selectively fuse the powder of the build material 270 into larger structures by rapidly melting the powder particles that may melt or diffuse into the solid structure below, and subsequently, cool and re-solidify. As such, based on the control of the laser beam 262, each layer of build material 270 may include unfused and fused build material 270 that respectively corresponds to the cross-sectional passages and walls that form the article 250. In general, the laser beam 262 is relatively low power to selectively fuse the individual layer of build material 270. As an example, the laser beam 262 may have a power of approximately 50 to 500 Watts, although any suitable power may be provided.

Upon completion of each layer, the fabrication support 214 is lowered and the delivery support 234 is raised. Typically, the fabrication support 214, and thus the article 250, does not move in a horizontal plane during this step. The roller or wiper 236 again pushes a portion of the build material 270 from the delivery device 230 to form an additional layer of build material 270 on the working plane 216 of the fabrication device 210. The laser beam 262 is movably supported relative to the article 250 and is again controlled to selectively form another cross-sectional layer. As such, the article 250 is positioned in a bed of build material 270 as the successive layers are formed such that the unfused and fused material supports subsequent layers. This process is continued according to the modeled design as successive cross-sectional layers are formed into the completed multi-walled thermal isolating service tube.

The delivery of build material 270 and movement of the article 250 in the vertical direction are relatively constant and only the movement of the laser beam 262 is selectively controlled to provide a simpler and more precise implementation. The localized fusing of the build material 270 enables more precise placement of fused material to reduce or eliminate the occurrence of over-deposition of material and excessive energy or heat, which may otherwise result in cracking or distortion. The unfused and fused build material 270 may be reused, thereby further reducing scrap.

Any suitable laser and laser parameters may be used, including considerations with respect to power, laser beam spot size, and scanning velocity. As a general matter, the build material 270 may be formed by any suitable powder, including powdered metals, such as a stainless steel powder, and alloys and super alloy materials, such as nickel-based or cobalt superalloys. In one exemplary embodiment, the build material 270 is a high temperature nickel base super alloy such as IN718. In other embodiments, MAR-M-247, IN738, titanium, aluminum, titanium-aluminide, or other suitable alloys may be employed. In general, the powder build material 270 may be selected for enhanced strength, durability, and useful life, particularly at high temperatures, although as described below, the powder build material 270 may also be selected based on the intended function of the area being formed.

When the tube is complete, it is removed from the additive manufacturing system (e.g., from the DMLF system 200). The complete tube may undergo finishing treatments. Finishing treatments may include, for example, aging, annealing, quenching, peening, polishing, hot isostatic pressing (HIP), or coatings. For example, during a HIP process, an encapsulation layer is applied to the article and pressure and heat are applied to remove or reduce any porosity and cracks internal to or on the surface of the component, as described in U.S. patent application Ser. No. 12/820,652, titled "METHODS FOR MANUFACTURING TURBINE COMPONENTS," filed Jun. 22, 2010, and published as United States Patent Application Publication No. 2011/0311389, on Dec. 22, 2011, the contents of which are herein incorporated by reference in their entirety. The encapsulation layer functions to effectively convert any surface porosity and cracks into internal porosity and cracks, and after the application of pressure and heat, removes or reduces the porosity and cracks. Such encapsulation layers may be subsequently removed or maintained to function as an oxidation protection layer.

In one exemplary embodiment, the encapsulation layer may be a metal or alloy that is compatible with the substrate and may be applied by a plating or coating process, as described below. In one embodiment, the HIP process may be performed at a processing temperature in a range of about 1000° C. to about 1300° C. and may be performed at a pressure in a range of about 1 ksi to about 25 ksi for a time period of about 1 to about 10 hours. In other embodiments, the HIP processing temperature, pressure, and time may be smaller or larger to form a compacted solid having negligible porosity.

If necessary, the thermal isolating service tube may be machined to final specifications. At this point, "the service tube" as referred to herein regarding additive manufacturing techniques corresponds with the finished thermal isolating service tube shown in the figures. In further steps (not shown), the thermal isolating service tube may be tested and installed in a gas turbine engine, such as shown in FIGS. 1 and 2. While thermal isolating service tubes 100*a*, 100*b*, and 100*c* have been described for use with an oil system of a gas turbine engine, it is to be understood that the thermal isolating service tubes according to exemplary embodiments may be used with other systems in the gas turbine engine as well as with systems in other than gas turbine engines when thermal isolation is desired between fluid adapted to flow in the inner tubular member and the medium externally adjacent to the thermal isolating service tube and/or external structure and/or when there are service tube routing challenges.

While thermal isolating service tubes as oil supply, scavenge, drain and ventilation tubes have been described, it is to be understood that the thermal isolating service tubes in accordance with exemplary embodiments may be used for other applications wherever it is necessary to thermally isolate a fluid in the internal tubular member from the environment, for compliance, and/or to address routing challenges. While thermal isolating service tubes having multiple walls have been described, it is to be understood that the unitary thermal isolating service tube may transition from a multiple wall structure to a single walled structure. For example, the unitary thermal isolating service tube may have multiple walls to pass through a gas path, and then transition to the single walled structure when the need for thermal isolation terminates.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

From the foregoing, it is to be appreciated that thermal isolating service tubes and assemblies thereof for gas turbine engines help reduce heat loads and coking, resulting in reduced bearing and engine maintenance, increased bearing and engine life, and reduced engine overhaul and removals. In addition, the thermal isolating service tubes in accordance with exemplary embodiments are more easily routed within the stationary structural frame of the gas turbine engine.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A service tube assembly for a gas turbine engine, comprising:

an external structure associated with the gas turbine engine having a non-cylindrical opening therethrough;

a thermal isolating service tube including:

an inner tubular member defining a fluid passage through which a first fluid flows;

at least one outer tubular member disposed about the inner tubular member to define a spacing volume therebetween, the spacing volume defining a second fluid passage for receiving a second fluid, and an outermost outer tubular member of the at least one outer tubular member has an end portion terminating in a mounting flange, the mounting flange is substantially thermally isolated from the inner tubular member by at least one wall that extends from the end portion to define a second spacing volume between the mounting flange and the outermost outer tubular member, the at least one wall coupled to the end portion at a first end and coupled to the mounting flange at a second end; and at least one spacer defined from the inner tubular member that extends radially toward the at least one outer tubular member in the spacing volume such that a gap is defined between the spacer and an interior wall of the at least one outer tubular member in the spacing volume, wherein the thermal isolating service tube comprises a unitary structure and has at least one portion with a curved configuration, a non-circular cross-sectional shape, or both.

2. The service tube assembly of claim 1, wherein the inner tubular member has a cross-sectional shape that is different from a cross-sectional shape of the at least one outer tubular member.

3. The service tube assembly of claim 2, wherein at least one of the inner tubular member or the at least one outer tubular member comprises a non-cylindrical tubular member.

4. The service tube assembly of claim 1, wherein the unitary structure comprises a non-cylindrical tubular structure.

5. The service tube assembly of claim 1, wherein the unitary structure has the at least one portion with the non-circular cross-sectional shape and an adjacent portion with a circular cross-sectional shape.

6. The service tube assembly of claim 1, wherein the unitary structure has the at least one portion with the non-circular cross-sectional shape and an adjacent portion with a different non-circular cross-sectional shape.

7. The service tube assembly of claim 1, wherein the at least one portion of the thermal isolating service tube is configured and dimensioned to pass through the non-cylindrical opening in the external structure.

8. The service tube assembly of claim 7, wherein the non-cylindrical opening in the external structure has substantially the same cross-sectional shape as a cross-sectional shape of the at least one portion of the thermal isolating service tube.

9. The service tube assembly of claim 1, wherein the second fluid is a cooling fluid for cooling the inner tubular member, and the first fluid is oil.

10. A service tube assembly for a gas turbine engine, comprising:

an external structure associated with the gas turbine engine having a non-cylindrical opening therethrough; and a unitary thermal isolating service tube comprising an inner tubular member defining a fluid passage through which a first fluid flows and at least one outer tubular member disposed about the inner tubular member to define a spacing volume therebetween, the spacing volume defining a second fluid passage for receiving a second fluid, with at least one spacer defined from the inner tubular member that extends radially toward the at least one outer tubular member in the spacing volume such that a gap is defined between the spacer and an interior wall of the at least one outer tubular member in the spacing volume and an outermost outer tubular member of the at least one outer tubular member has an end portion terminating in a mounting flange, the mounting flange is substantially thermally isolated from the inner tubular member by at least one wall that extends from the end portion to define a second spacing volume between the mounting flange and the outermost outer tubular member, the at least one wall coupled to the end portion at a first end and coupled to the mounting flange at a second end, wherein at least one portion of the unitary thermal isolating service tube is configured with a non-circular cross-sectional shape and dimensioned to pass through the non-cylindrical opening.

11. The service tube assembly of claim 10, wherein the non-cylindrical opening in the external structure has substantially the same cross-sectional shape as a cross-sectional shape of the at least one portion of the unitary thermal isolating service tube.

12. The service tube assembly of claim 11, wherein the at least one portion of the unitary thermal isolating service tube has the non-circular cross-sectional shape, and an adjacent portion of the unitary thermal isolating service tube has a circular cross-sectional shape.

13. The gas turbine engine of claim 10, wherein the fluid is oil or air, and the second fluid is a cooling fluid for cooling the inner tubular member.

14. A gas turbine engine comprising:

a rotor bearing in a bearing sump of the gas turbine engine, and an oil system for lubricating and cooling the rotor bearing with oil when the gas turbine engine is operating, wherein the oil system is coupled to a plurality of service tubes and at least one service tube of the plurality of service tubes comprises a thermal isolating service tube, the thermal isolating service tube comprising:

an inner tubular member defining a fluid passage in communication with the oil system through which a fluid flows; and at least one outer tubular member disposed about the inner tubular member and defining a spacing volume between at least the inner tubular member and the at least one outer tubular member, the spacing volume defining a second fluid passage for receiving a second fluid, with at least one spacer defined from the inner tubular member that extends radially toward the at least one outer tubular member in the spacing volume such that a gap is defined between the spacer and an interior wall of the at least one outer tubular member in the spacing volume and an outermost outer tubular member of the at least one outer tubular member has an end portion terminating in a mounting flange, the mounting flange is substantially thermally isolated from the inner tubular member by at least one wall that extends from the end portion to define a second spacing volume between the mounting flange and the outermost outer tubular member, the at least one wall coupled to the end portion at a first end and coupled to the mounting flange at a second end, and wherein the thermal isolating service tube comprises a unitary structure and has at least one portion with a curved configuration, a non-circular cross-sectional shape, or both.

15. The gas turbine engine of claim 14, wherein the at least one portion of the thermal isolating service tube is configured and dimensioned to pass through a non-cylindrical opening in an external structure within the gas turbine engine.

16. The gas turbine engine of claim 15, wherein the external structure comprises a stationary structural frame, a fairing, or a diffuser housing.

17. The gas turbine engine of claim 14, wherein the non-cylindrical opening in the external structure has substantially the same cross-sectional shape as a cross-sectional shape of the at least one portion of the thermal isolating service tube.

18. The gas turbine engine of claim 14, wherein the fluid is oil or air, and the spacing volume defines a second fluid passage through which a cooling fluid flows for cooling the inner tubular member.

* * * * *